United States Patent [19]

Laing

[11] 4,189,894

[45] Feb. 26, 1980

[54] METHOD OF AND APPARATUS FOR WRAPPING PRODUCTS

[75] Inventor: Robert Laing, Sutton, Mass.

[73] Assignee: Curtis & Marble Machine Company, Worcester, Mass.

[21] Appl. No.: 937,055

[22] Filed: Aug. 28, 1978

[51] Int. Cl.[2] ..... B65B 11/04

[52] U.S. Cl. ..... 53/399; 53/465; 53/587; 53/211; 53/216

[58] Field of Search ..... 53/399, 465, 587, 211, 53/212, 213, 214, 215, 216, 217

[56] References Cited

U.S. PATENT DOCUMENTS

| | | | |
|---|---|---|---|
| 910,871 | 1/1909 | Sill . | |
| 2,215,174 | 9/1940 | Dyken . | |
| 2,233,068 | 2/1941 | Ashcroft . | |
| 2,246,525 | 6/1941 | Matter . | |
| 2,301,016 | 11/1942 | Cannard . | |
| 2,746,224 | 5/1956 | Wollett . | |
| 2,795,093 | 6/1957 | Ott . | |
| 2,938,319 | 5/1960 | Nystrand . | |
| 3,659,394 | 5/1972 | Hartleib . | |
| 3,678,646 | 7/1972 | Clark | 53/587 |
| 3,991,538 | 11/1976 | Finn et al. . | |

FOREIGN PATENT DOCUMENTS

| | | | |
|---|---|---|---|
| 334636 | 9/1930 | United Kingdom | 53/216 |

*Primary Examiner*—John Sipos

*Attorney, Agent, or Firm*—Norman S. Blodgett; Gerry A. Blodgett

[57] ABSTRACT

Method of and means for wrapping generally cylindrical products with plastic film in which the film extends from a supply roll over a supporting means and terminates in a free end. The product is placed on the supporting means, the free end of the film is transferred to the product and the product is rotated to draw film from the supply roll and cause it to be wrapped around the product. The wrapped product is removed from the supporting means and the film is severed.

32 Claims, 13 Drawing Figures

99
100
101
135
DRIVE
400
137
M
37
401
402
M
39
403
104
101
102
START
RH
EMERGENCY STOPS
EMPTY FILM DETECTORS
404
START
LH
108
RH
LH
CR 6
405
106
406
110
407
109
114
408
112
LS8
156
409
CR M
410
116
411
CR 7
412
120
118
136
122
124
126
413
LS2
150
414
CR 1
415
T2
416
128
T1
417
418
130
69
419
132
C1
420
134
CLUTCH
COUNT
421
148
LS3
422
CR 2
423
138
101
BRAKE LOGIC CARD
144
140
424
TENSION POT
BRAKE 98
425

METHOD OF AND APPARATUS FOR WRAPPING PRODUCTS

BACKGROUND OF THE INVENTION

In industry and commerce, there are many types of products which must be packaged in order to protect them from exposure to the elements during shipping and storage. It is common practice, for this purpose, to use a clear plastic sheet that is wrapped around the item to be packaged. This is generally accomplished by extending a sheet of plastic across an opening and conveying the product through the opening transversely to the plane of the sheet. For this reason there is a minimum of tension on the film to allow the product to move against the sheet and extend the sheet as it passes through the opening. Portions of the sheet above and below the product are brought together behind the product and severed to free the product from the plastic sheet. The free ends of the film extending from the product are fused to form a complete package around the product. The ends away from the product are fused to extend a new sheet across the opening for the next product. In a typical operation, two rolls of plastic are used, one above and one below the opening through which the products are conveyed. The ends of each roll are fused together to form a continuous curtain of plastic film across the opening. Since the film is wrapped around the product with a minimum of tension, a preshrinkable plastic film is often used and the wrapped products are subjected to heat treatment for shrinkage in an oven commonly referred to as a shrink tunnel. Equipment for carrying out this operation is complex, expensive, and usually quite large. The heat shrinking operation constitutes an added manufacturing step which requires considerable space and absorbs considerably energy. These and other difficulties experienced with the prior art devices have been obviated in a novel manner by the present invention.

It is, therefore, an outstanding object of the invention to provide a method of and apparatus for wrapping generally cylindrical items with plastic sheet from a single source of supply.

Another object of the invention is the provision of the method of and apparatus for wrapping a generally cylindrical product with plastic sheet under sufficient tension to produce a finished wrapped product without the need of a heat shrinking operation.

A further object of the present invention is the provision of automatic machinery for wrapping a cylindrical product placed within the machinery and to discharge the wrapped product from the machinery after wrapping.

It is another object of the instant invention to provide apparatus which will automatically carry out selected steps of the wrapping method of the present invention, the remaining steps being performed by hand operation.

A still further object of the invention is the provision of apparatus for wrapping generally cylindrical products of different diameters.

It is a further object of the invention to provide apparatus for wrapping products utilizing plastic film which is of a relatively tacky nature which will adhere to the product but which can be separated from engaging machine elements by the use of pressurized air.

It is a further object of the invention to provide apparatus for wrapping generally cylindrical products which are simple in construction, which is inexpensive to manufacture, and which occupies a minimum of floor space during use.

With these and other objects in view, as will be apparent to those skilled in the art, the invention resides in the combination of parts set forth in the specification and covered by the claims appended hereto.

SUMMARY OF THE INVENTION

In general, the invention consists of a method of wrapping a cylindrical object with plastic film having sufficient softness and frictional characteristics for enabling the film to adhere to the surface of the product on contact therewith, the method consisting of extending a free end of the film from a supply roll over a supporting means to a cut-off line spaced from the supporting means, placing the cylindrical product against the film on the supporting means, transferring the free end of the film from the cut-off line to the product to enable the film to adhere to the surface of the products, rotating the product on the support means causing the film to be wrapped around the product as it is rotated, rolling the product from the support beyond the cut-off line, so that the product rotates about its central longitudinal axis in the direction opposite from that in which it was wrapped thereby partially unwrapping the film from the product. The film is then cut along the cut-off line and the product is rotated in the same direction in which it was originally wrapped to wrap the portion of the film which extends from the product to the cut-off line onto the product thereby producing a finished wrapped product. Machinery is provided for automatically carrying out all of the steps of method of the instant application. The extent to which the specific steps are automatically carried out depends on a specific need of the mills utilizing the equipment. These needs depend on such factors as volume, types and size of products, variability or uniformity of products and capability for capital investment.

More specifically, the plastic film is wrapped around the product with sufficient tension to produce a tight finish wrap, eliminating the need for a shrink treatment of the film. In all embodiments, pressurized air is used as the prime moving force or as an assisting force in transferring the free end of the wrapping film from the cut-off line to the product on the supporting means. In the preferred embodiment in which a mechanical element is employed to physically transport the film to the product, air pressure is utilized to release the relatively tacky film from the transporting element to the product.

Another feature of the invention involves the use of a starter strip of plastic material for wrapping certain types of cylindrical products. A starter strip is used in conjunction with support means comprising a pair of spaced drive rolls. The wrapping film extends upwardly from a supply roll between the two drive rolls and over one of the drive rolls to terminated at the cut-off line. The starter strip extends over both drive rolls from a supply roll and also terminates at the cut-off line. Starter strip and wrapping film are both transferred from the cut-off line to the product supported on the support means. During subsequent rotation of the product, the free end of the wrapping film is prevented from going downwardly between the two drive rolls by the starter strip, so that both the starter strip and the wrapping film are wrapped around the product.

Tension of the wrapping film is controlled by means of an electro-magnetic brake applied to the wrapping film supply roll. The brake is variable and is controlled by electrical means by which the tension of the film can be adjusted for different wrapping conditions. Additional circuitry is provided for tying in the operation of the braking means with other machine controls, so that tension is applied to the film only during the step of wrapping the film around the product.

BRIEF DESCRIPTION OF THE DRAWINGS

The character of the invention, however, may be best understood by reference to several of its structural forms, as illustrated by the accompanying drawings, in which.

DESCRIPTION OF THE PREFERRED EMBODIMENT

Figure 1:
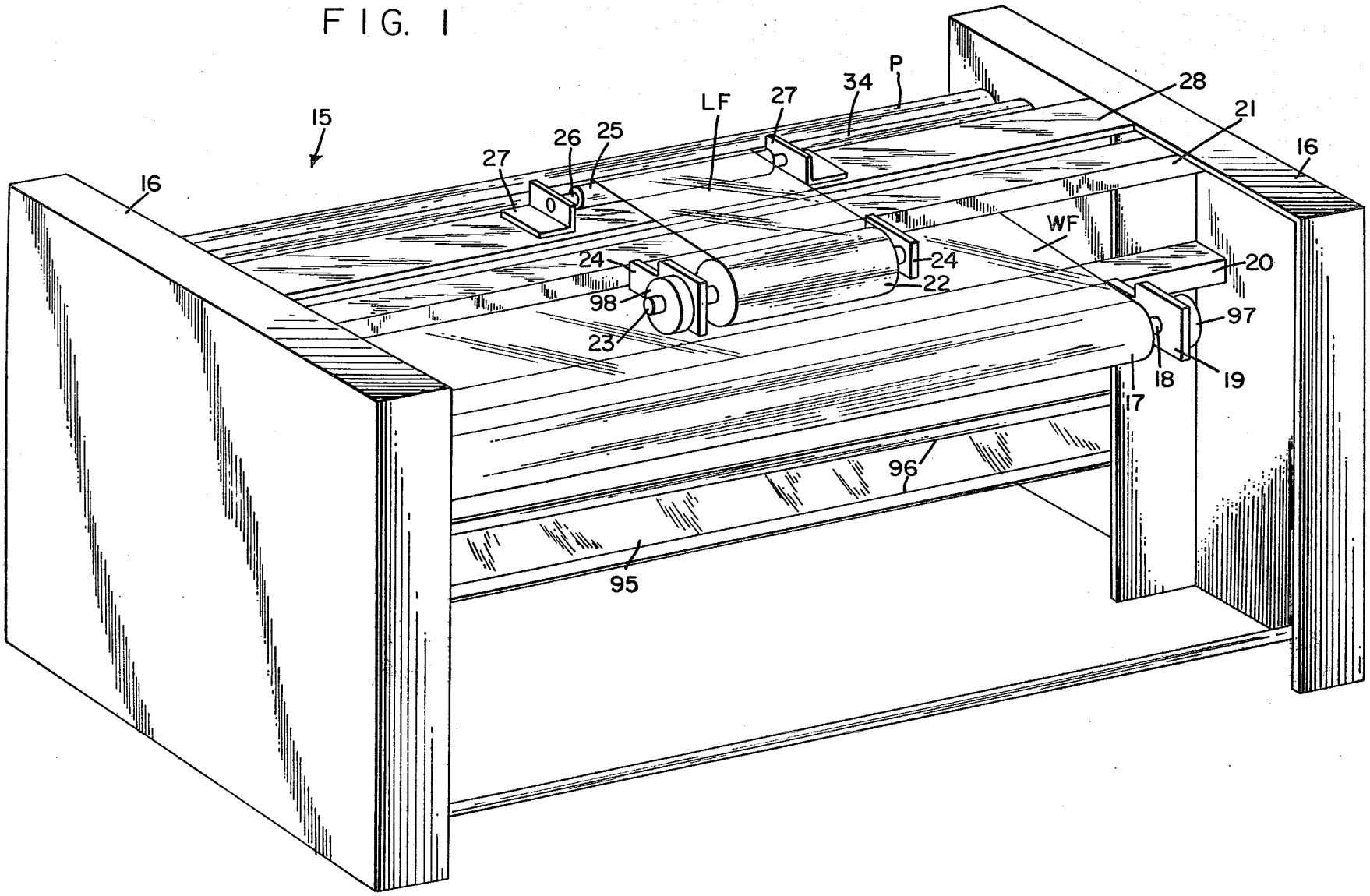
FIG. 1 is a perspective view of the preferred wrapping apparatus embodying the principles of the present invention.
Figure 2:
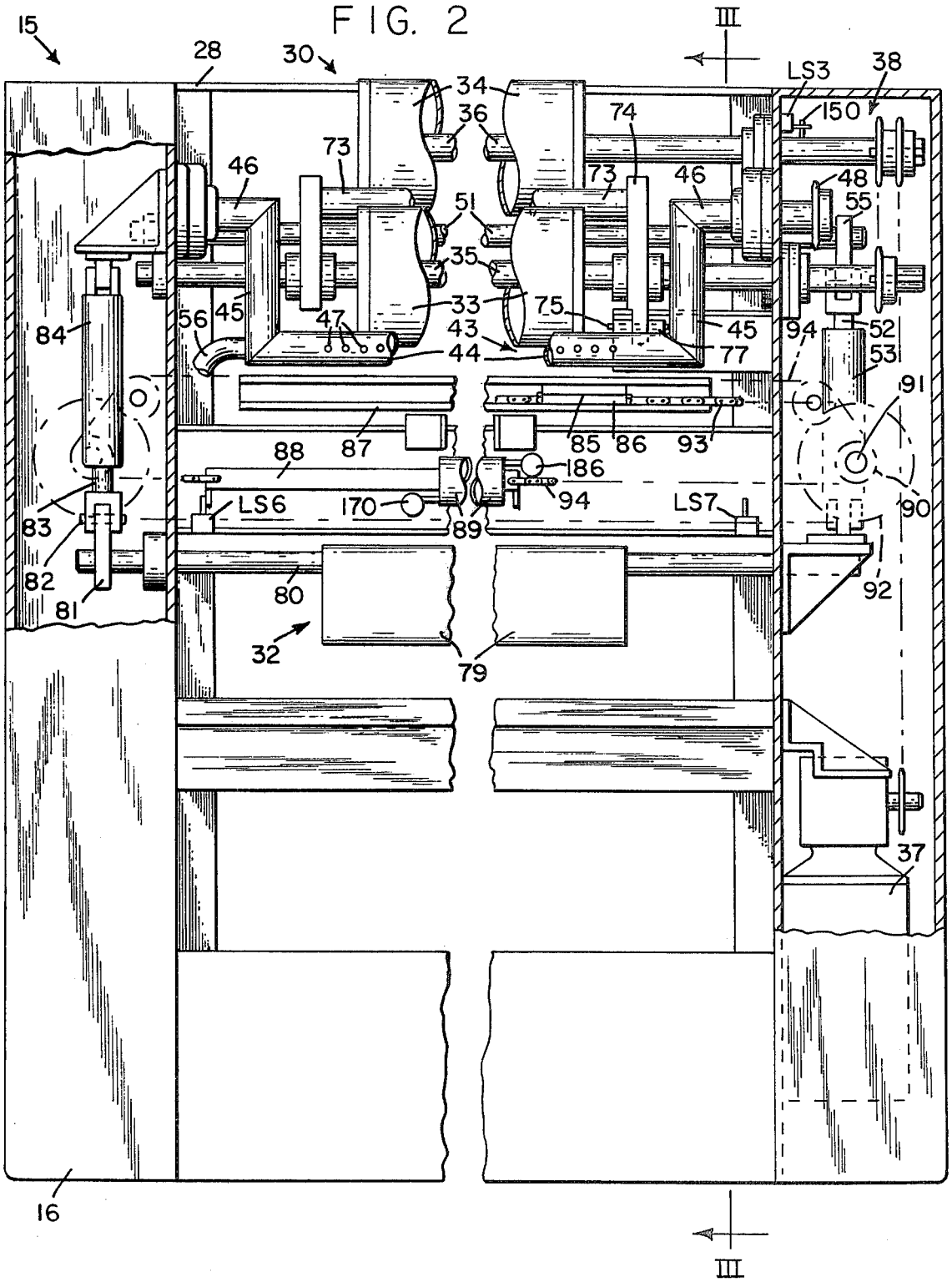
FIG. 2 is a front elevational view of the apparatus in FIG. 1 with portions broken away, without the film and product.
Figure 3:
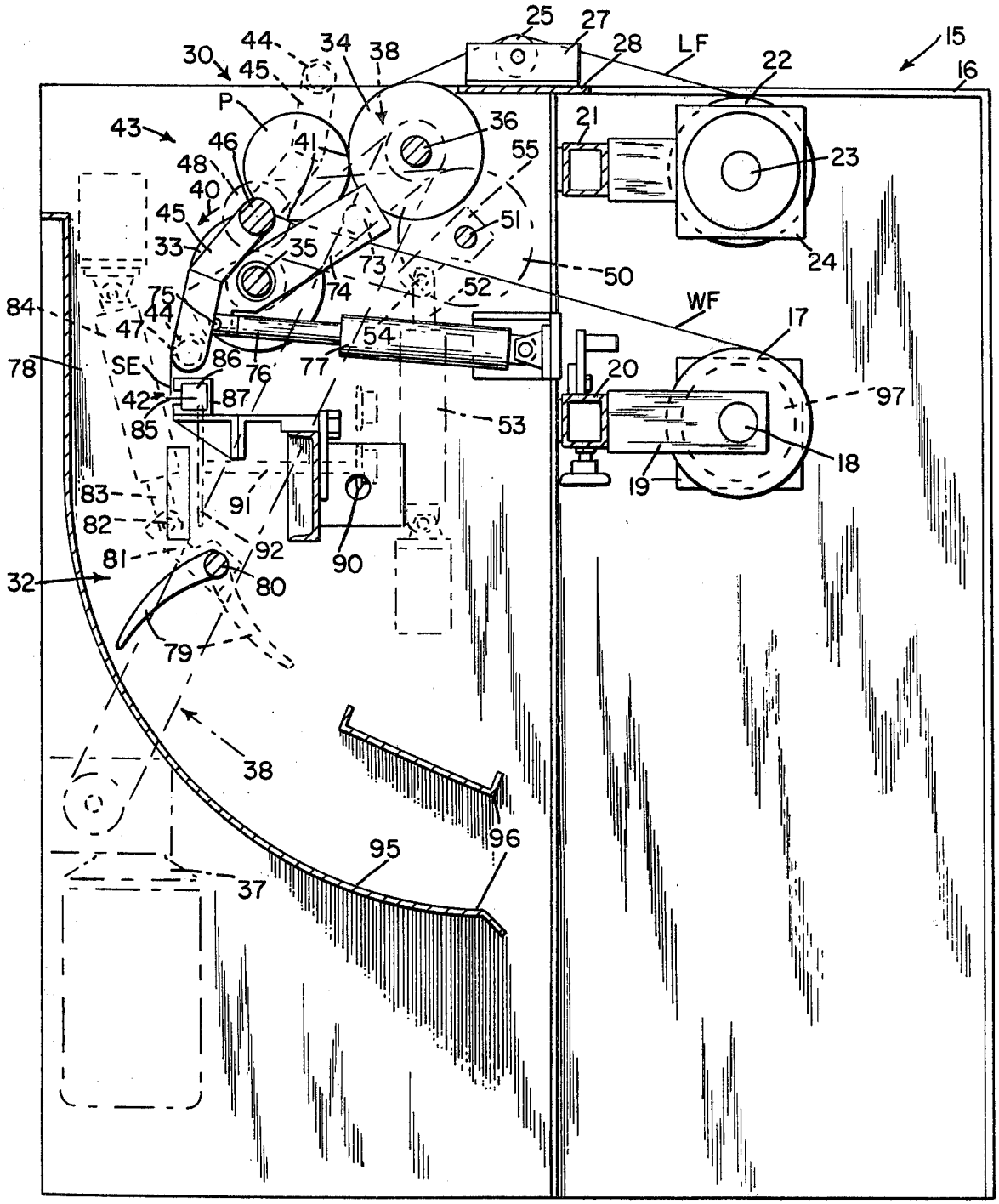
FIG. 3 is a vertical sectional view taken along line III—III of FIG. 2 and looking in the direction of arrows, with the film and product in wrapping position.

Referring first to FIGS. 1, 2, and 3, there is shown a preferred machine for carrying out the principles of the present invention. The preferred machine is indicated generally by the reference numeral 15 and is effective to carry out most of the functional steps automatically.

Machine 15 comprises a generally rectangular framework 16, including cross-girts 20 and 21. A supply roll 17 of wrapping film is mounted on a shaft 18 journaled between brackets 19–19 supported from cross-girt 20. The wrapping film indicated at WF extends from roll 17 toward the front of the machine. The roll 22 of leader or starter film indicated at LF is mounted on a shaft 23 journaled within supporting brackets 24–24 extending from cross-girt 21. The leader film LF extends upwardly and forwardly over a guide roll 25, rotatably mounted on a shaft 26 journaled between supporting brackets 27–27 extending from a top girt 28.

Referring particularly to FIGS. 2 and 3, the wrapping instrumentalities are located at the front of the machine (at the left as shown in FIG. 3) and include a first support means generally indicated by the reference numeral 30 and a second support means generally indicated by the reference numeral 32. First support means 30 comprises two spaced elongated drive rolls 33 and 34 keyed to horizontally extending shafts 35 and 36, respectively, journaled within the machine framework 16. The elements which would not be seen in a sectional view taken along line III—III of FIG. 2 are shown in dot and dash lines in FIG. 3 to show their relative positions. Rolls 33 and 34 are driven from a motor 37 through a chain and sprocket drive indicated generally by the reference numeral 38. Rolls 33 and 34 are driven in the same direction indicated by arrow 40 (counterclockwise as viewed in FIG. 3). Rolls 33 and 34 form an upper supporting nip 41 therebetween for supporting an elongated generally cylindrical product indicated at P in FIG. 3. Wrapping film WF extends forwardly from supply roll 17 over roll 33 and terminates in a free end at a cut-off line indicated at 42. The leader film LF extends forwardly from supply roll 22 over guide roll 25 and over rolls 34 and 33 also terminates in a free end at cut-off line 42 the free ends of films LF and WF are indicated by the reference SE in FIG. 3. When the product P is placed within nip 41, the wrapping film WF extends between the product and the roll 33 and the leader film LF extends between the product and roll 34 and also between the product and roll 33, as shown in FIG. 2.

The means for transferring the free ends SE of the films WF and LF from cut-off line 42 to the product are generally indicated by the reference numeral 43 and comprise a horizontally extending tube 44 supported between a pair of arms 45 fixed to a pair of rotatably mounted stub shafts 46. Tube 44 contains a plurality of apertures 47 along its length and normally occupies the lower full line position, as shown in FIGS. 2 and 3, behind the films LF and WF as shown in FIG. 3. Tube 44 is moved from its normal full line position to an upper dotted line position in a transfer stroke which is effective to carry the films to the product. The means for moving tube 44 in the transfer stroke, includes a sprocket 48 keyed to one of the shafts 46 and driven by a chain 49 trained around a larger sprocket 50 keyed to a shaft 51. A piston 52 is slidably mounted within an air cylinder 53 and is pivotally attached at 54 to an arm 55 also keyed to shaft 51. Actuation of air cylinder 53 causes its piston 52 to move from the full line position to the dotted line position, as shown in FIG. 3. This motion of piston 52 is effective to rock arm 55 from its full line position to its dotted line position and causing shaft 51 and sprocket 50 to rotate clockwise, as viewed in FIG. 3. A clockwise motion of sprocket 50 causes sprocket 48 to also rotate clockwise, thereby rotating shaft 46 clockwise and causing tube 44 to move from the full line position to the dotted line position.

One end of tube 44 is connected to a flexible air tube 56, as shown in FIG. 2. The opposite end of tube 56 is connected to air control means generally indicated by the reference numeral 57, see particularly FIG. 4. Air control mechanism 57 includes a housing 58 mounted on a supporting bracket 60 fastened to the outside of framework 16. Housing 58 comprises a pressure port 61 and a vacuum port 62. A flexible hose 63 connects the pressure port 61 to the outlet side of an air pump 64. A flexible tube 65 connects the vacuum port 62 to the inlet side of pump 64. The end of flexible tube 56 is connected to a passage 59 in a slide element 66, slidingly guided on housing 58 between a position of pneumatic registry with port 62 and a position of pneumatic registry with port 61. Piston 67 is slidably mounted in a double acting cylinder 68 and is attached to one end of slide element 66. A solenoid operated valve 69 is connected to opposite ends of cylinder 68 by air lines 70 and 71 and to an air line 72 connected to a source of air pressure, not shown. Valve 69 is effective to connect one end of the cylinder 68 to the source of air pressure.

Figure 4:
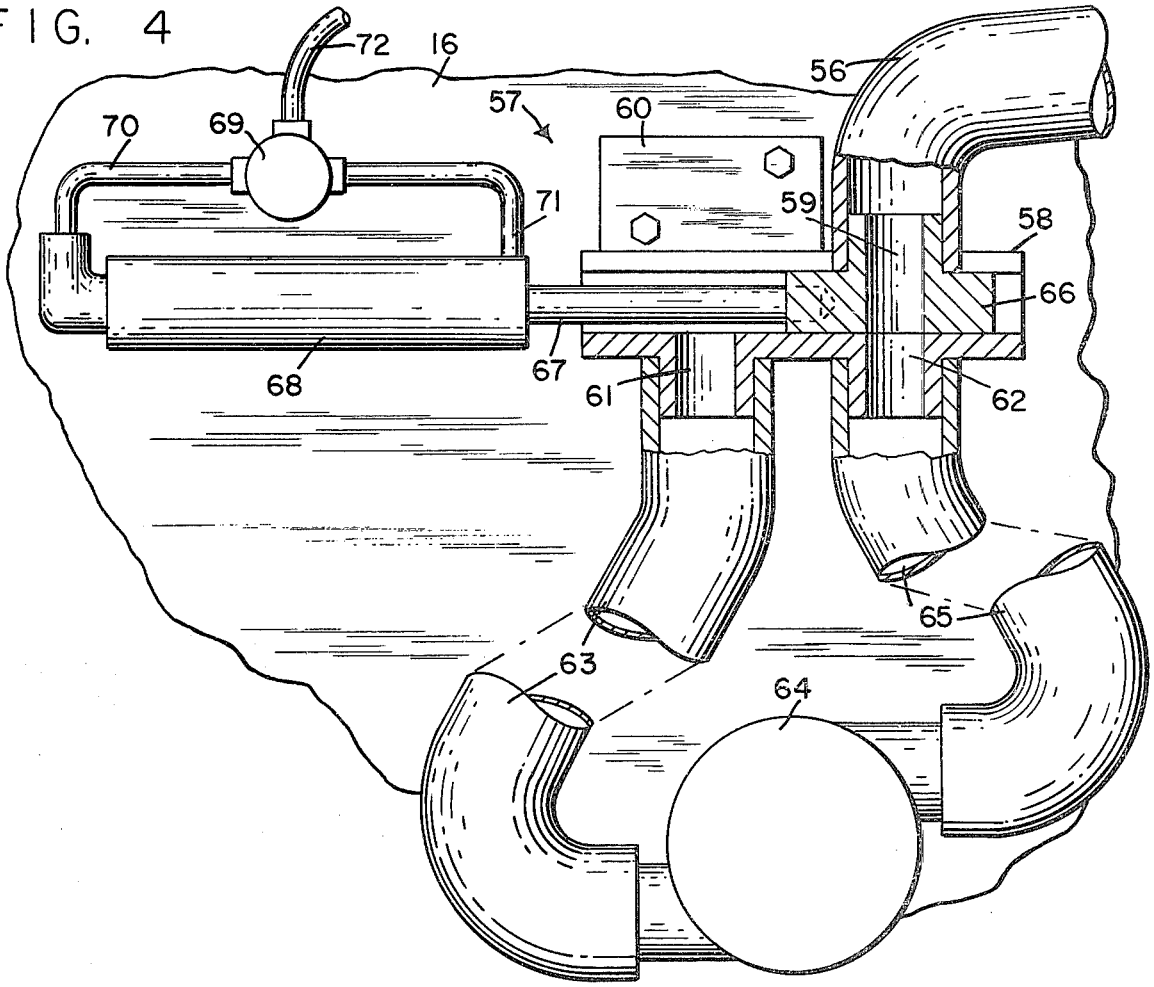
FIG. 4 is a fragmentary view of pneumatic controls for the film transferring apparatus of the machine shown in FIGS. 1, 2, and 3, FIGS. 5–8 are operational views showing the method steps of the present invention as carried out by the apparatus shown in FIGS. 1–4.

When the right-hand end of cylinder 68, as viewed in FIG. 4, is pressurized, piston 67 is drawn into the cylinder toward the left, as viewed in FIG. 4, thereby shifting passage 59 from vacuum port 62 to provide pressurized air to tube 56 and when the left-hand end of cylinder 68 is pressurized, as viewed in FIG. 4 through air line 70, piston 67 is driven out of cylinder 68 toward the right as viewed in FIG. 4, thereby shifting passage 59 from the pressure port 61 to the vacuum port 62.

Referring again to FIGS. 2 and 3, the air control mechanism 57, shown in FIG. 4, is effective to create subatmospheric pressure in tube 44 when it is in the lower full line position and during its motion from the full line position to the dotted line position. This causes a suction through the apertures 47 for drawing the films against the tube 44, as an aid in transferring the film from the cut-off line 42 to the product P supported within the nip 41 of the drive rolls. When the tube 44 reaches the upper or dotted line position, as shown in FIG. 3, the air control mechanism 57 operates to product super-atmospheric pressure in tube 44 by connecting passage 59 to pressure port 61. The pressurizing of tube 44 creates outwardly directed jets of air through apertures 47. The jets of air are effective to blow the films LF and Wf away from the tube 44 toward the product P. This prevents the films from sticking to the tube 44 and allows the tube to return from the dotted line position to the lower full line postion without dragging the films back with it.

Once the films WF and LF have been transferred to the surface of the product P. rotation of the rolls 33 and 34 in a counter-clockwise direction, as viewed in FIG. 3, will cause the product P to rotate in the clockwise direction and thereby cause the films to be wrapped around the product. After a predetermined number of wraps, the product is ejected from nip 41 by an ejector mechanism comprising a horizontal bar 73 extending below the product P and attached to one end of a bell-crank lever 74 pivotally mounted on shaft 35. The opposite end of lever 74 mounted within an air cylinder 77. Cylinder 77 is positively actuated by two solenoid valves, one for drawing piston 76 into the cylinder and the other for extending the piston out of the cylinder. Actuation of cylinder 77 to draw piston 76 into the cylinder rotates lever 74 counterclockwise to shift horizontal bar 73 from the position below nip 41 as shown in FIG. 3 to the position shown in FIG. 6. This motion of horizontal bar 73 is effective to push the product P out of the nip 41 and cause it to fall down a guide chute 78 toward the second support means 32. As the product P falls down the guide chute 78, it rotates in a counter-clockwise direction aided by roll 33 which acts as a rolling guide, as viewed in FIG. 3, thus causing a portion of the wrapping film WF and leader film LF to unwrap from the product P. Product P falls in the chute 78 until it strikes a gate 79 extending across the bottom of the chute and forming part of the support means 32. Gate 79 is mounted on a shaft 80 rotatably mounted within the framework 16. One end of a lever 81 is keyed to shaft 80 and the opposite end is pivotally attached at 82 to the end of a piston 83 slidably mounted within an air cylinder 84. Cylinders 84 and 53 are shown in their normal state in FIG. 2. These two cylinders are controlled by solenoid valves and control means to be described so that upon an actuation of their respective valves, their respective pistons are shifted to their opposite positions out of the cylinder. Actuation of cylinder 84 causes piston 83 to be driven out of the cylinder. This causes shaft 80 to partially rotate in a counter-clockwise direction, thereby shifting gate 79 from its full line position to the dotted line position shown in FIG. 3 to release the product resting on lever 79 from the bottom of chute 78. Prior to its release from chute 78, the product P resting on gate 79 causes the partially unwrapped films to extend across the cut-off line 42. A double-edged knife 85 supported in a block 86 is located at one side edge of the films at the cut-off line 42. Block 86 is slidably guided within an elongated U-shaped bracket 87 extending across the width of the machine behind cut-off line 42. Knife 85 is driven from one side of the machine to the other, traveling in an alternate direction for succesive operations. Referring particularly to FIG. 2, the drive means for knife 85 comprises a piston 88 slidably mounted in a double acting air cylinder 89. Piston 88 extends from both ends of the cylinder 86 and the outer ends thereof are attached to the ends of a chain 94. Chain 94 is trained around a sprocket 90 keyed to the shaft 91 to which is also keyed a larger sprocket 92. A chain 93 is trained around sprocket 92 and the ends thereof are attached to opposite ends of the knife supporting block 86, as shown in FIG. 2. Cylinder 86 is controlled by a solenoid valve and appropriate electrical control means to be described, so that when the knife 85 is positioned at the right-hand side of the films, as shown in FIG. 2, the left-hand portion of piston 88 is out of the cylinder 86. During the subsequent wrapping cycle, cylinder 86 will be actuated so that the right-hand end of piston 88 will be pushed out of the cyclinder and the left-hand end drawn in, thereby causing the knife 85 to move across the machine from right to left, as viewed in FIG. 2. Travel of the knife 85 in either direction along cut-off line 42 will enable it to cut the films extending upwardly from a product P lying on gate 79 to be severed at the cut-off line 42. Because of the difference in size between sprockets 90 and 92, a relatively small motion of piston 88 will produce a relatively large motion of the knife 85.

After severing of the films along cut-off line 42, the product P resting on gate 79 is released from chutes 78 by the movement of gate 79 from the full line position to the dotted line position, as shown in FIG. 3. The released product P drops further onto a curved floor 95 which acts as a cam surface on the product P causing it to roll in the clockwise direction as viewed in FIG. 3, thereby rewinding the portions of the films which extend from the product to the cut-off line as it rested on gate 79, see also FIG. 8. The product P continues to roll along floor 95 toward an exit opening 96 at which point it drops into a shipping receptacle or onto a conveyor, neither of which are shown, to be carried toward a shipping station.

The products P as they leave the exit opening 96 are wrapped with film under sufficient tension to enable the products to be shipped or stored for shipment without the need of a film shrinking procedure. Tension is applied to the films while the product P is being wrapped on the drive rolls 34 and 33 by electro-magnetic brake elements and electrical controls therefore, to be described in connection with the electrical circuitry. The tension on wrapping film WF is controlled by an electro-magnetic brake 97 mounted on one of the brackets 19 for controlling the rotation of the shaft 18 on which the wrapping film roll 17 is mounted. A second electro-magnetic brake 98 is mounted on one of the brackets 24 for controlling the rotation of shaft 23 on which the leader film roll 22 is mounted. After the films are transferred to the product P, braking force is gradually applied to the shafts 23 and 18 by the electro-magnetic brakes 98 and 97, respectively, until enough film has been wrapped on the product so that the film is securely held on the product to warrant application of full braking force by the electro-magnetic brakes to produce the desired maximum tension on the films.

GENERAL OPERATION OF AND CONTROL CIRCUITRY FOR THE PREFERRED EMBODIMENT

Figure 12A:
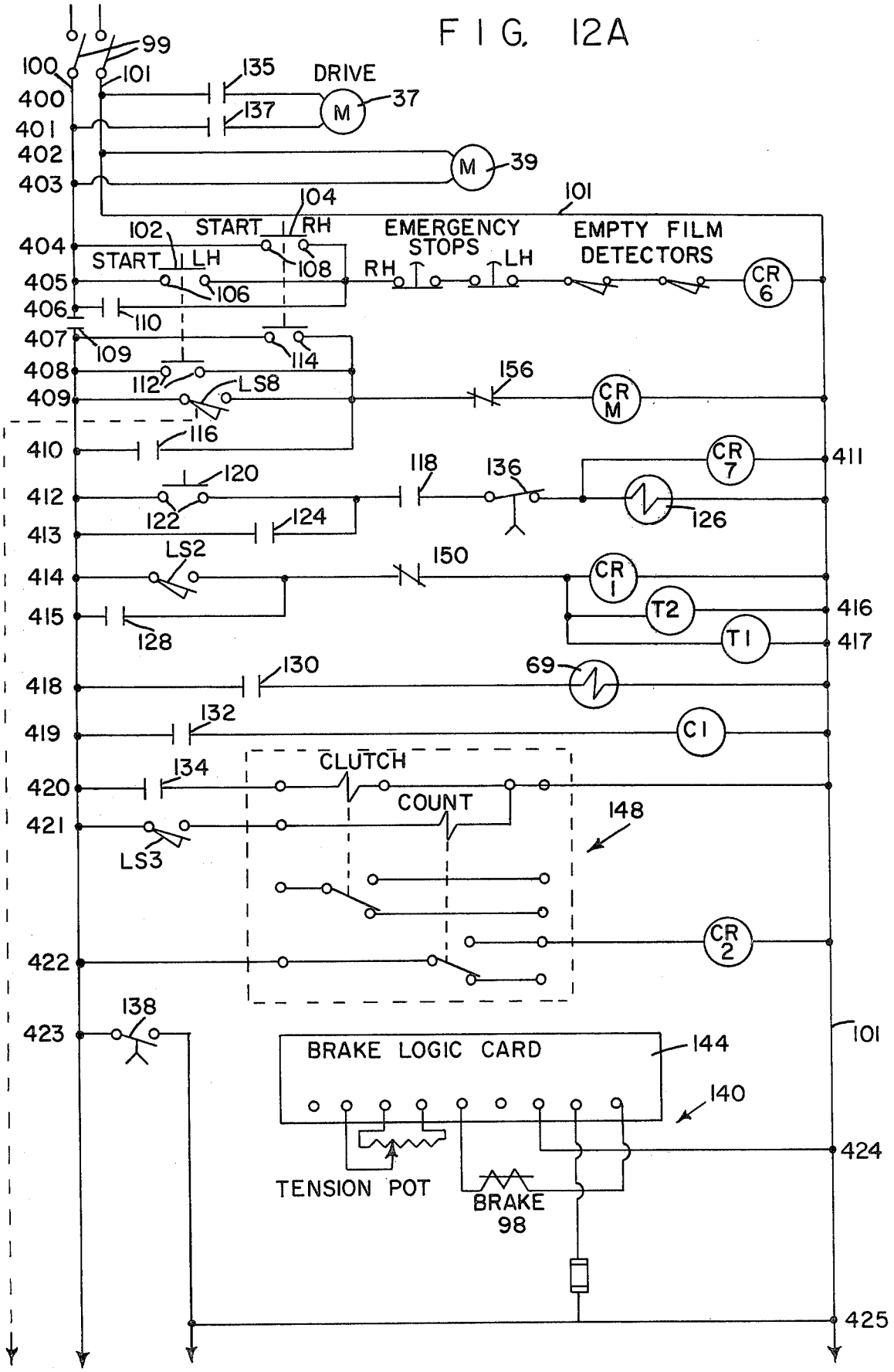
FIG. 12*a* and 12*b* are wiring diagrams for the fully automatic machine shown in FIGS. 1–4.
Figure 12B:
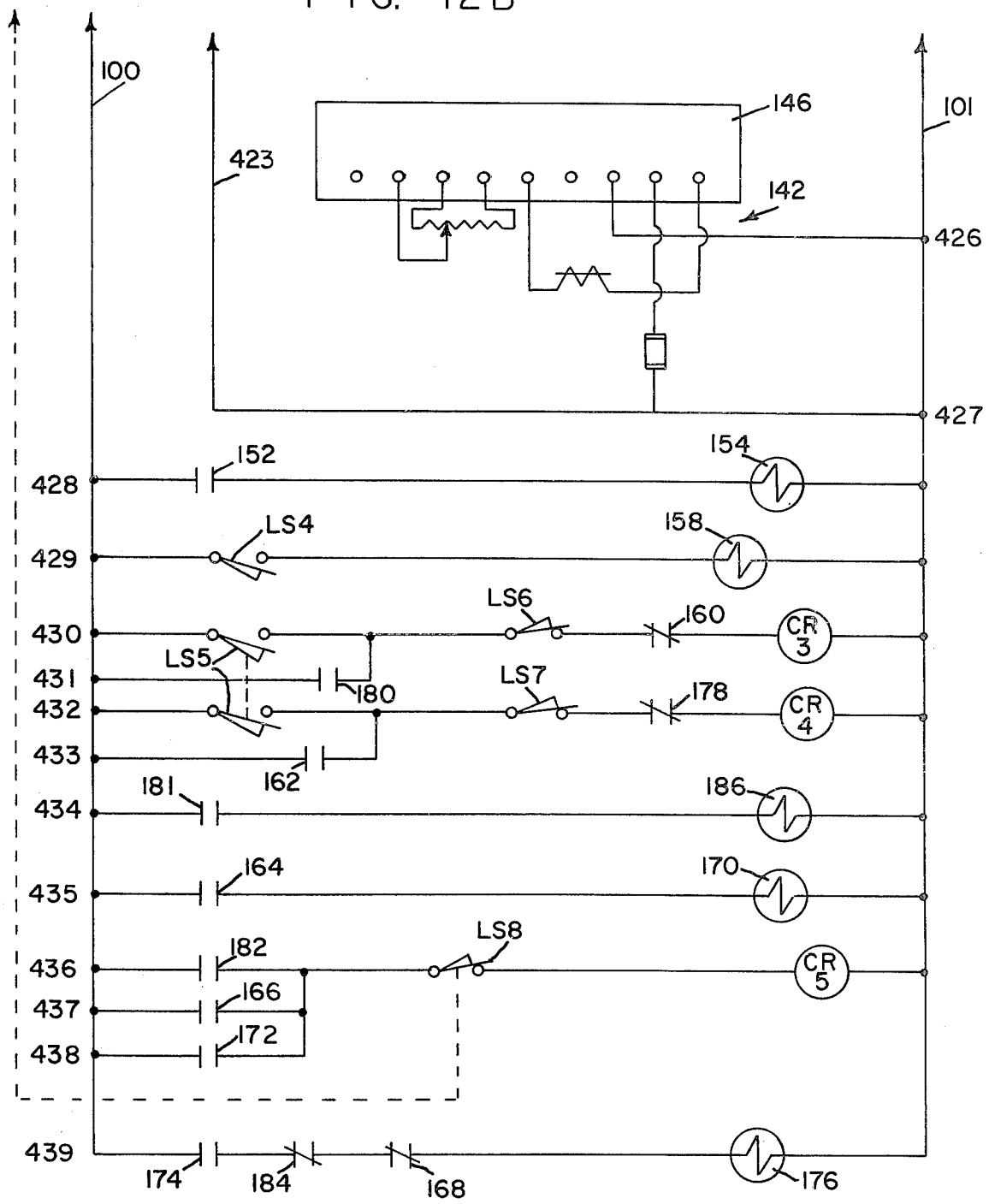

Referring particularly to FIG. 12, there is shown an electrical diagram for controlling the various machine elements described in connection with the preferred embodiment shown in FIGS. 1-4. FIG. 12 is shown in two sections, 12A and 12B, on separate sheets and connected at the points of the arrows extending from lines 100, 101, and 427. The control circuitry shown in FIG. 12, comprises a pair of power lines, 100 and 101, across which are connected a plurality of lines numbered from 400 at the top of FIG. 12 to 439 at the bottom of FIG. 12. The numeral designation of these lines are located consecutively along the outside of power lines 100 and 101 adjacent to the lines to which they refer for easy reference.

Figure 5:
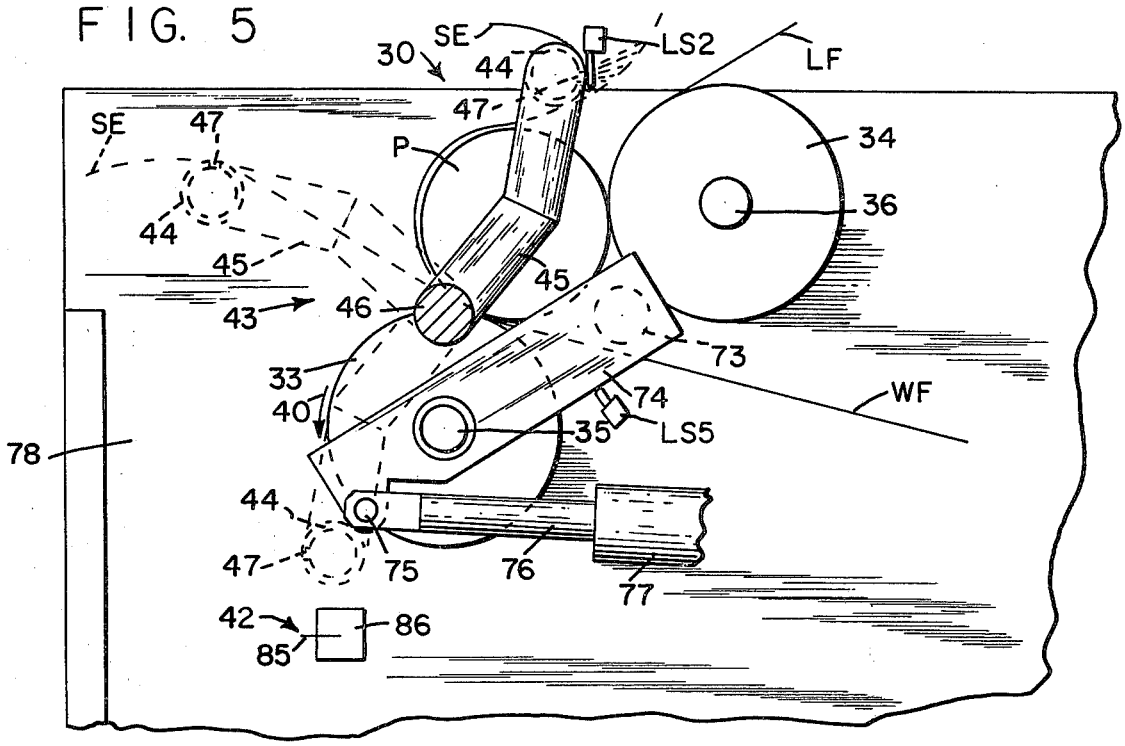

At the beginning of a wrapping operation, the film WF extends from its supply roll 17 over the drive roll 33 down to the cut-off line 42 and the leader film LF extends from its supply roll 22 over drive rolls 34 and 33 and to cutoff line 42. The cylindrical product P to be wrapped is placed within the nip 41 between rolls 33 and 34, as shown in FIG. 3, either by hand or by an automatic supply conveyor. Assuming the machine had been idle, the operator pushes either the left-hand start button 102, or the right-hand start button 104 which are effective to close contacts 106 and 108, respectively on lines 405 and 404, respectively. In either case, a relay CR6 on line 405 is energized, which upon energization, closes its normally open holding contact 110 on line 406 to maintain CR6 energized when either of the start buttons 102 and 104 is released. Energization of relay CR6 also closes its contact 109 on line 100 to activate the circuitry below line 406. Start buttons 102 and 104 is released. Line 405 contains normally closed empty film detector switches and emergency stop switches, any one of which is effective when opened to de-energize CR6. Start buttons 102, 104 are also effective when depressed to close normally open contacts 112 and 114, respectively, on lines 408 and 407, respectively. Closing of either of the contacts 112 or 114 will energize a relay CRM on line 409 which, when energized, will close its normally open holding contact 116 on line 410 to maintain relay CRM energized upon release of either of the start buttons 102 or 104 and to close its normally open contact 118 on line 412. The description to this point represents a preliminary starting phase of a wrapping operation. The actual wrapping sequence cannot begin until relay 118 is closed, allowing line 412 to be electrically connected across the power lines 100 and 101 upon the pressing of a second start button 120 on line 412. When the operator depresses start button 120, contacts 122 are closed which energizes a relay CR7 on line 411. Energization of relay CR7 closes a normally open holding contact 124 on line 413 to maintain power across line 412 when the start button 120 is released. The coil of a solenoid valve 126 controls air cylinder 53 so that when its coil is energized, cylinder 53 is operated to drive its piston 52 out of the cylinder for driving the tube 44 from its lower full line position shown in FIG. 3 to its upper dotted line position. At this time, passage 59 is in register with the vacuum port 62, as shown in FIG. 4 so that subatmospheric pressure is created in tube 44. This subatmospheric pressure draws air into tube 44 through apertures 47 and holds the films WF and LF against the tube as its moves from the lower position to the upper position. This motion of tube 44 carries the free ends SE of the film over the package P as shown in full line in FIG. 5. When the tube 44 reaches the upper position shown in FIG. 5, the arm of a normally open limit switch LS2 on line 414 is engaged to close switch LS2 and thereby energize relay CR1 on line 414, a time delay relay T2 on line 416, and a time delay relay T1 on line 417. Energization of relay CR1 closes its normally open holding contact 128 on line 415 and also closes normally open contacts 130, 132, and 134 on lines 418, 419, and 420, respectively.

Closing of contact 132 on line 419 energizes a relay C1 which closes its normally open contacts 135 and 137 on lines 400, 401, respectively, thereby energizing motor 37 causing drive rolls 33 and 34 to be driven for rotation in a counter-clockwise direction, as shown in FIG. 3. Closing of contact 130 on line 418 energizes a coil for solenoid valve 69 which, upon energization shifts the air pressure from line 70 to line 71, thereby drawing piston 67 into the cylinder 68, see FIG. 4. This is effective to draw the slide 66 toward the cylinder and shift the passage 59 of tube 56 from the vacuum port 62 to the pressure port 61. Pump 64 is driven continuously by a motor 39 on lines 402 and 403. Motor 39 is actuated as soon as power is supplied to power lines 100 and 101 by closure of a double pole double throw switch 99. Shifting of passage 59 to port 61 creates a superatmospheric pressure in tube 44, thereby creating air streams from apertures 47 to blow the films from the full line position to the dotted line position shown in FIG. 5, thereby separating the films from the tube 44 and transferring them to the product P. The simultaneous rotation of drive rolls 33 and 34 causes the films thus transferred to product P to be wrapped around the product as the product is rotated by the drive rolls. After a predetermined time interval, time delay relay T1 on line 417 opens its normally closed contact 136 on the line 412, thereby de-energizing the coil of solenoid valve 126 and allowing piston 52 to be drawn into its normal position within air cylinder 53. This causes tube 44 to be returned from its upper position, shown in FIGS. 3 and 5, to its lower position. After a predetermined time interval, time delay relay T2 on line 416 operates to close its normally open contact 138 on line 423, thereby supplying power to logic brake circuits 140 and 142. Logic circuits 140, 142 supply voltage to electro-magnetic brakes 98 and 97, respectively, for creating tension in the films as they are wrapped gradually around the product. Voltage to the brake is increased gradually to a point of maximum desired tension. The rate of voltage increase and the final voltage value is controlled by logic cards 144 and 146 for circuits 140 and 142, respectively. A supply of logic cards having different programmed values are kept on hand and cards having the desired voltage profiles are selected and inserted into the logic circuit 140 and 142. The amount of time before contact 138 is closed to connect the logic circuits 140 and 142 depends on the size of the products being wrapped and the particular nature of the wrapping material. As a general rule, the amount of time should be enough to allow for three-quarters of a wrap around the product before tension is applied to the films.

Closing of contact 134 on line 420 energizes a rotation counter 148. The particular counter which has been used is sold by Industrial Controls Division of Gulf and Western Manufacturing Company, model HZ-17186-GE. This particular counter operates by receiving electrical impulses and after a number of predetermined impulses have been received, it is effective to control other electrical components connected to the timer. In this particular case, the electrical impulses are received from a limit switch LS3 on line 421. LS3 is normally open and is closed momentarily by a pin 150 extending from shaft 36 upon each rotation of the roll 34, see FIG. 2. Each closing of switch LS3 adds one pulse to the counter 148 and after a predetermined number of pulses has been received, indicating the number of revolutions of roll 34, timer 148 operates to draw current across line 422, to which it is connected, to energize a relay CR2 located on line 422. Timer 148 can be manually set so that it will operate after receiving fewer or more pulses as desired. Whatever the setting, the timer will automatically reset itself to the selected set position after each timing sequence. The setting of time 148 will, of course, depend on the size of the product to be wrapped.

Figure 6:
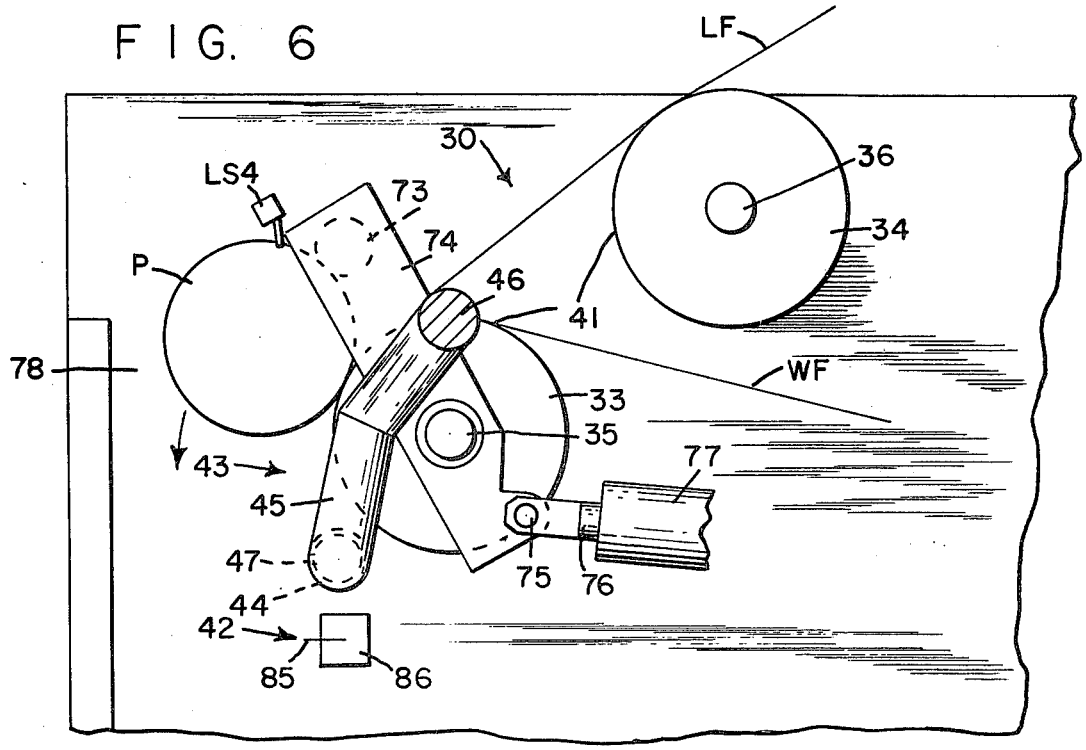
Figure 7:
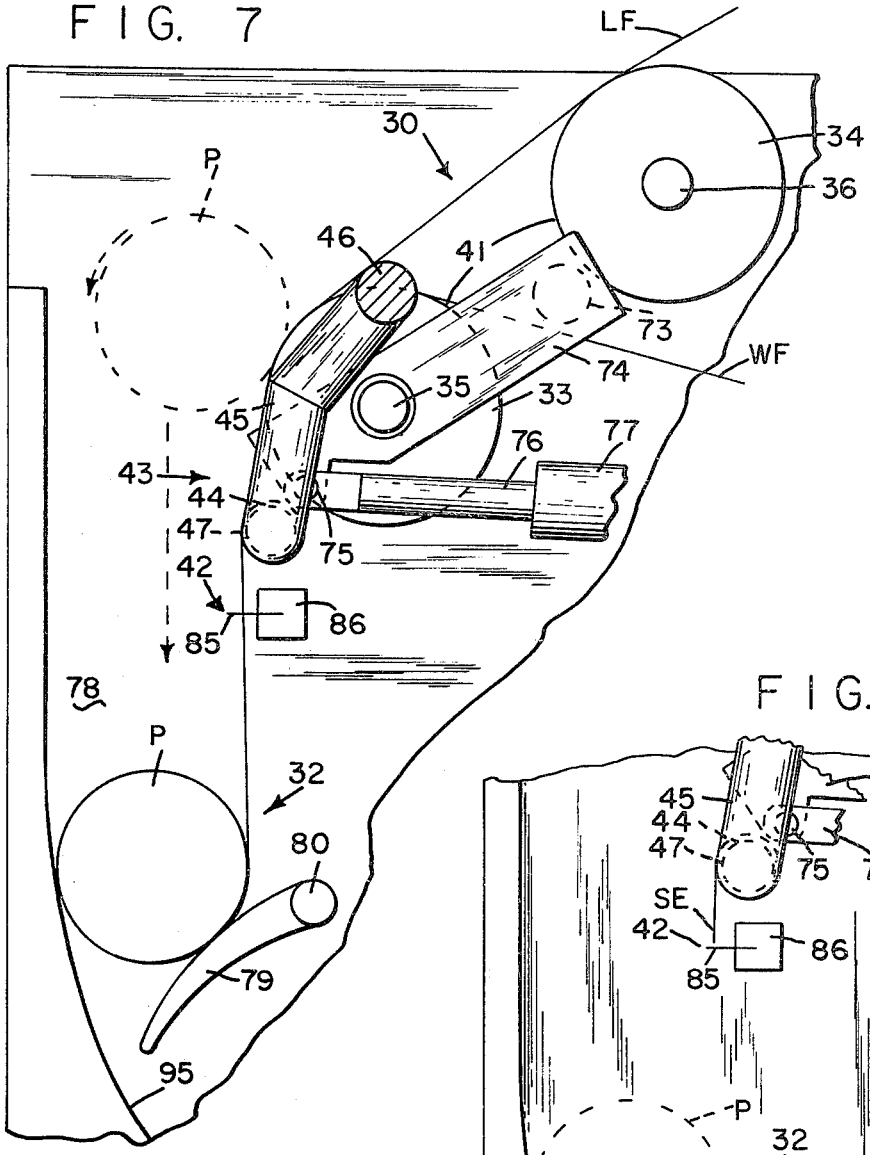

Energization of relay CR2 opens its normally closed contact 150 on line 414, thereby breaking the electrical connection across line 414 and de-energizing relays CR1, T2, and T1 on lines 414, 416, and 417, respectively. Energization of relay CR2 also opens its normally closed contact 156 on line 409, thereby de-energizing relay CRM. De-energization of relay CRM opens its contacts 116 and 118 on lines 410 and 412, respectively. Opening of contact 118 prevents solenoid valve 126 from becoming energized when contact 136 on line 412 is closed due to the de-energization of relay T1 on line 417. De-energization of relay T2 opens its contact 138 on line 423 to cut power to the logic brake circuits 140 and 142. Opening of contact 130 on line 418 de-energizes a coil to solenoid valve 69 and causes the cylinder 68 to return passage 59 to the vacuum port 62, as shown in FIG. 4, thereby creating sub-atmospheric pressure in the tube 44. Opening of contact 132 on line 419 de-energizes relay C1, thereby opening contacts 135 and 137 on lines 400 and 401 to de-energize the motor 37 and stop the rotation of drive rolls 33 and 34. Opening of contact 134 on line 420 deactivates the counter 148. Energization of relay CR2 also closes its normally open contact 152 on line 428, thereby energizing the coil of a solenoid valve 154 which controls air cylinder 77. Energization of solenoid valve 154 causes piston 76 to be drawn into the cylinder 77, thereby causing ejector bar 73 to swing from the position beneath the product shown in FIGS. 3 and 5 to the position shown in FIG. 6, thereby ejecting the wrapped product P from the nip 41 towards the mouth of the chute 78, as shown in FIG. 6. When the ejector bar 73 reaches the position shown in FIG. 6, the arm of a normally open limit switch LS4 will engaged to close switch LS4 located on line 429 to energize the coil of a solenoid valve 158. It should be noted at this point that the various limit switches shown in the figures are diagrammatically represented for ease and understanding of the operation of the invention. The limit switches are preferably located at points outside of the machine frame and are engaged by extending portions of the elements with which they are associated. It is only important to know the relative position of the particular element at the time of actuation of its corresponding limit switch. Upon energization of its coil, solenoid valve 158 also controls cylinder 77, except that it causes piston 76 to return to its extended position, shown in full line in FIGS. 3 and 5, and return the ejector bar 73 back to its position beneath the nip 41. As the ejector bar 73 moves from the position shown in FIG. 6, to the position shown in FIGS. 3 and 5, the switch arm of a normally open double throw switch LS5 on line 430 and 432 is momentarily closed. Upon closing of switch LS5, one of the relays CR3 and CR4 on lines 430 and 432, respectively, will be energized, depending on the position of the knife 85. If the knife 85 is at the right-hand side, as shown in FIG. 2, piston 88 will be extended to the left and in engagement with a normally closed limit switch LS6 on line 430. When the piston 88 is in this position, limit switch LS6 is open to prevent relay CR3 from becoming energized. When the knife 85 is at the right-hand side, as viewed in FIG. 2, a normally closed limit switch LS7 on line 432 is not engaged by the piston 88, thereby remaining closed and enabling relay CR3 to become energized upon closing of switch LS5. Energization of relay CR4 opens one of its normally closed contacts 160 on line 430 to prevent relay CR3 from becoming energized while the cutter moves from right to left, as viewed in FIG. 3 and closes its normally open contact 162 on line 433 to maintain itself in the energized state after switch LS5 opens. Energization of CR4 closes normally open contacts 164 and 166 on lines 435 and 437, respectively and opens normally closed contacts 168 on line 439. Closing of contact 164 energizes the coil of a solenoid valve 170 on line 435 which is effective to pressurize the lefthand end of cylinder 89, as viewed in FIG. 2, to extend piston 88 to the right and, consequently, drive knife 85 across the width of the machine from right to left, as viewed in FIG. 2. By the time that knife 85 begins its travel across the machine, the wrapped product P has reached the bottom of the chute 78 and is resting on gate 79, as shown in full lines in FIG. 7. During its fall in chute 78, a portion of the wrapped film is caused to become unwrapped from the product so that it extends from the product resting on gate 79 up to roll 33 and lies across the cutting line 42. Movement of the knife 85 along the cut-off line 42 severs the extending film along that line to form two free ends, SE from the supply rolls and PE from the product. The suction from tube 44 holds the extended film in position to insure proper cutting of the film. Closing of contacts 166 on line 437 causes a relay CR5 on line 436 to become energized. Energization of relay CR5 closes its normally open contacts 172 and 174 on lines 438 and 439, respectively. Contact 172 is a holding contact. The closing of contact 174 on line 439 is momentarily ineffective, since the normally closed contact 168 on the same line is momentarily opened upon energization of relay CR4. However, when the knife completes its travel to the right side of the machine, piston 88 engages the arm of normally closed switch LS7 on line 432 to open the switch and de-energize relay CR4. Upon de-energization of CR3, contacts 168 on line 439 is closed. As soon as contact 168 is closed, a solenoid valve 176 on line 439 is energized (contact 174 having already been closed by relay CR5). Solenoid valve 176 controls cylinder 84 and upon energization causes piston 83 to be driven outwardly from the cylinder and shift the gate 79 from its full line position to its dotted line position shown in FIG. 3, thereby releasing the wrapped product P from the bottom of chute 78 as viewed in FIG. 7 and allowing it to roll along cam surface 95 as viewed in FIG. 8 and out of the machine through opening 96. As the wrapped product P moves along surface 95, the portion of the film which extends from the package while it rests on the bar 79 to the cut-off line 42 is wrapped around the product.

Figure 8:
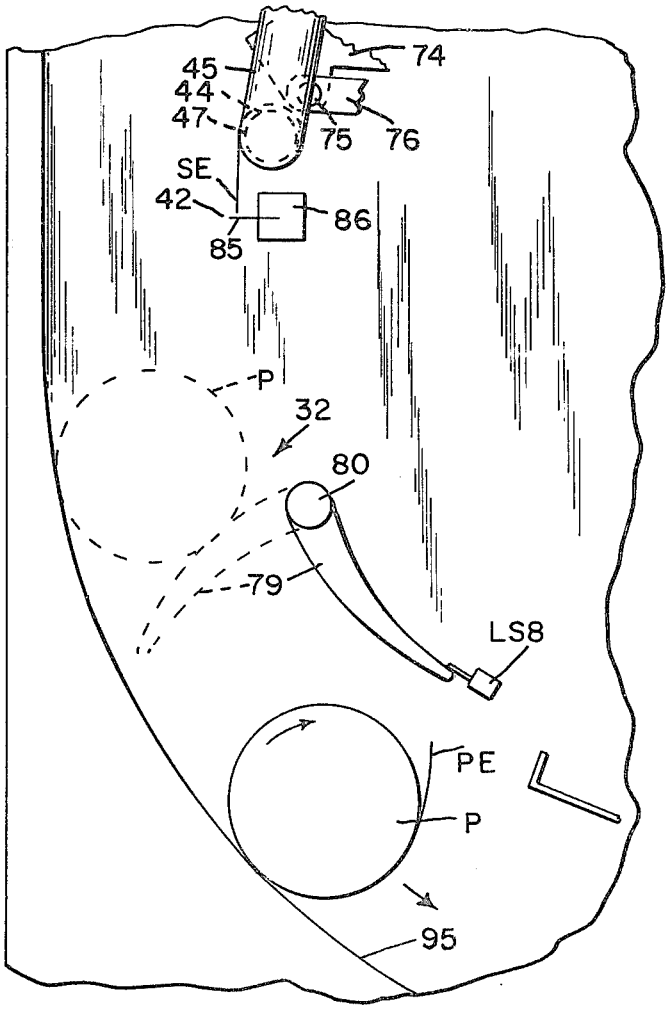

When the gate 79 reaches its release position, as shown in full lines in FIG. 8, it actuates the arm of a normally closed micro-switch LS8 to open the switch. Switch LS8 is located on line 436 and upon being opened, causes relay CR5 on line 436 to become de-energized, thereby causing holding contact 172 on line 438 to open. Contact 134 on line 439 is also opened to de-energize solenoid valve 176 and thereby allow gate 79 to return to its full line position, as shown in FIG. 3.

During the subsequent wrapping sequence, the knife 85 will be located at the left-hand side of the machine as viewed in FIG. 2. When knife 85 is in this position, piston 88 will be extended to the right of cylinder 89, so that it engages the arm of a normally closed micro-switch LS7 on line 432 to maintain the switch in the open condition. Upon closing of double pole switch LS5 when the rejector bar returns to its full line position, as shown in FIG. 3, after ejecting a wapped package from the nip 41, relay CR3 opens its normally closed contact on line 432 to prevent relay CR4 from becoming energized during travel of the knife across the machine. Energization of CR3 also closes its normally open holding contact 180 on line 431, closes its normally open contacts 181 and 182 on lines 434 and 436, respectively, and opens its normally closed contact 184 on line 439. Closing of contact 181 on line 434 energizes a solenoid valve 186 for pressurizing the right-hand side of cylinder 89, as shown in FIG. 2, thereby causing piston 88 to move to the left with respect to cylinder 89 and thereby driving knife 84 from the left-hand side of the machine to the right-hand side, as viewed in FIG. 2. Closing of contact 182 on line 436 energizes relay CR5 which closes its normally open contacts 172, 174 on line 438 and 439, respectively. As soon as the piston 88 reaches its extreme left-hand position, as viewed in FIG. 2, limit switch LS6 will be opened, thereby deenergizing relay CR3 and allowing its relay 184 on line 439 to close. Since contact 174 on line 439 is in the closed position by virtue of relay CR5 being energized, closing of contact 184 will cause solenoid valve 176 to become energized and cause gate 79 to move from its full line position to its dotted line position, as shown in FIG. 3. From this point on, the operation is identical to the previously-described wrapping sequence.

Under certain conditions, as for example when wrapping a product having sufficient weight, it has been found that the product can be wrapped without the use of a leader film. In such cases, the wrapping film WF extends from supply roll 17 over drive rolls 33 and 34 along the path normally occupied by the leader film. If the product P is sufficiently heavy, it will seat into nip 41, thereby deflecting the film into the nip. The wrapping sequence will be exactly as previously described, except that only the wrapping film will be transferred to the product and wrapped around the product. The leader film and its associated braking element will be removed from the machine and the electrical controls, therefore, will be disconnected from the circuitry when only the wrapping film is used.

FIRST MODIFICATION

Figure 9:
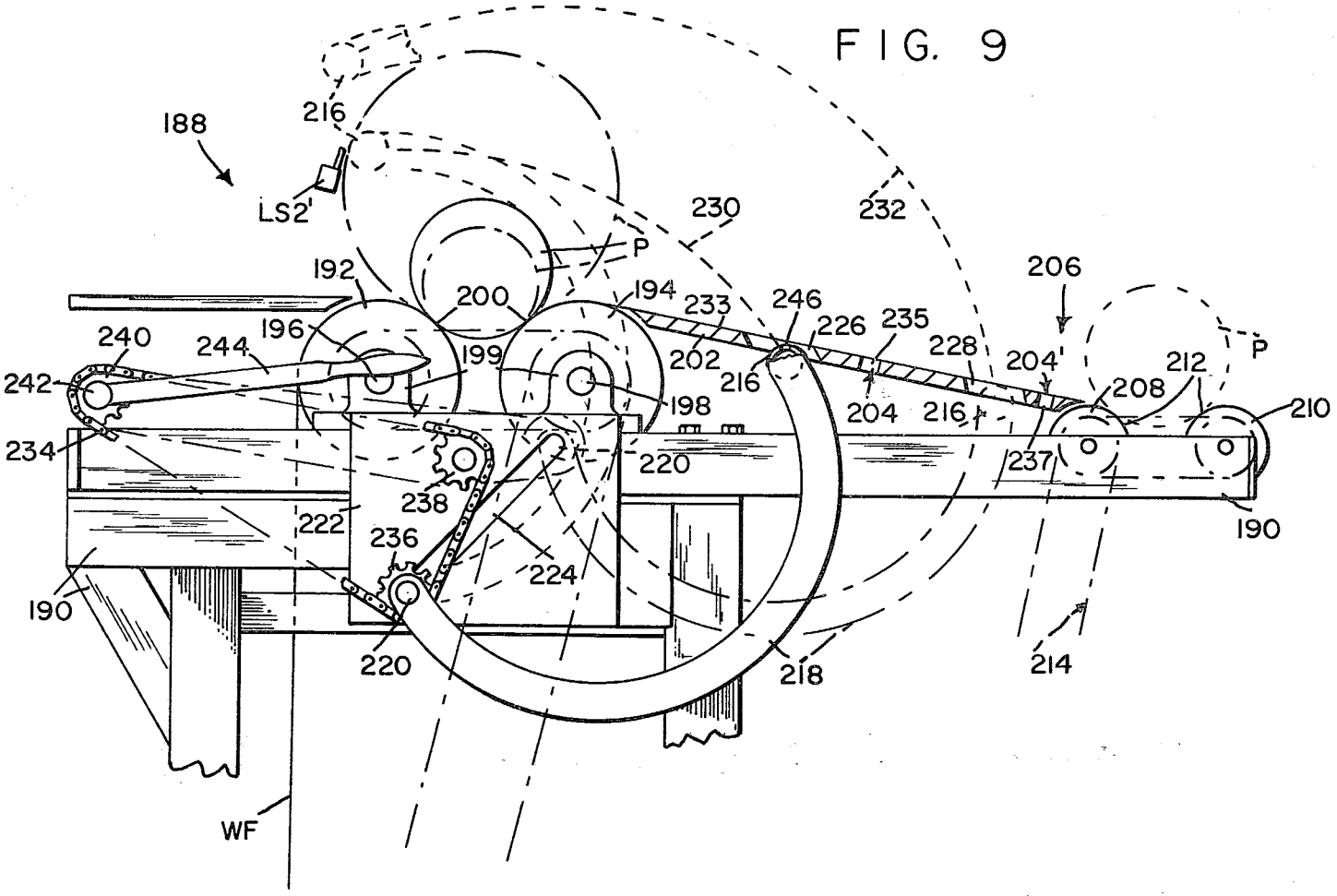
FIG. 9 shows a first modification of the apparatus for carrying out the method of the present invention.

Referring to FIG. 9, there is shown a first modification of the invention, generally indicated by the reference numeral 188. This modification differs from the preferred embodiment in that many of the automatic operations are eliminated, these operations being performed by hand by the operator. Modification 188 includes a framework 190 and a pair of spaced drive rolls 192 and 194 mounted on shafts 196 and 198, respectively, which are journaled in brackets 199 supported on the framework 190. Rolls 192 and 194 form a product supporting nip 200 therebetween. Nip 200 will support a product raning in size from the small circle shown in dot and dash lines to the larger circle, also shown in dot and dash lines. The film indicated at WF extends from a supply roll, not shown, but similar to that shown in the preferred embodiment, over rolls 192 and 194, over a guide plate 202 to a cut-off line 204. A product indicated at P rests on the wrapping film and is supported within the nip 200 of the drive rolls 192 and 194. Guide plate 202 extends from rolls 192 and 194 which form a first supporting means to a second supporting means generally indicated at 206 and comprising a pair of drive rolls 208 and 210. Drive rolls 208 and 210 form a product supporting nip 212 and are driven constantly by a drive means, indicated generally at 214, in a counter-clockwise direction, as viewed in FIG. 9. Drive rolls 192 and 194 are also driven in a counter-clockwise direction directly from a drive motor, not shown, in the same manner as drive rolls 33, 34 in the preferred embodiment.

The means for transferring the wrapping film to the product P comprises a tube 216 extending across the width of the machine and supported on an arm 218 pivotally mounted at 220 on a plate 222. Pivot 220 is adjustably mounted on plate 222 within a slot 224 from a lower position, shown in full lines in FIG. 9, to an upper dotted line position. When pivot 220 is in the lower position, tube 216 is located in the full line position, shown in FIG. 9, in alignment with a slot 226 in guide plate 202. When pivot 220 is in the upper position, tube 216 is located in its dot and dash line position in alignment with a second slot 228 in guide plate 202. When the pivot 220 is in the lower position, tube 216 will swing along an arc 230 enabling it to swing over products of relatively small diameter. When pivot 220 is in the upper position, tube 216 will swing along an arc 232 to accommodate products of relatively large diameter. Pivot 220 is locked in either of its operating positions by any conventional means such as a lock nut, not shown, threaded onto pivot 220 and located on the reverse side of the plate 222. In either position, tube 216 will swing from a lower position just below the upper surface 233 of guide plate 202 to a dotted line position over the product. When pivot 220 is in the lower position, tube 216 will swing along arc 230 through opening 226 and the cut-off line 204 is located just beyond slot 226 along a slot 235. When the pivot 220 is in the upper position, shown in FIG. 9, tube 216 will swing along arc 232 from a lower position just below surface 233 through slot 228 to an upper position above the product shown in dotted lines. In this position the cut-off line indicated at 204' is located just beyond slot 228 along a slot 237 in the guide plate 202.

The means for swinging tube 216 along its film transferring arc comprises a drive chain 234 trained around a sprocket 236 keyed to pivot 220, around an idler sprocket 238 and around a drive sprocket 240 keyed to a shaft 242. A hand-operated lever 244 is fixed to shaft 242. Lever 244 is effective when lifted from its lower full line position to its upper dotted line position, as shown in FIG. 9, to rotate drive sprocket 240, thereby rotating sprocket 236 through chain 234. This motion partially rotates pivot 220, causing tube 216 to swing from its lower position to its upper position, thereby transferring wrapping film WF extending across opening 226 or 228 to the product P to be wrapped. Tube 216 has a plurality of apertures 246 which extend along the entire length of the tube for the purpose of either drawing air into the tube or blowing air out of the tube in the same manner as described for tube 44 in the preferred embodiment.

The control circuitry for the modification shown in FIG. 9 is identical to that of the preferred embodiment with respect to starting of a wrapping sequence. The operation of the drive rolls, the pneumatic controls for tube 216, and the braking of the supply roll for the wrapping film WF to produce film tension. Since tube 216 is manually positioned, the controls associated with this operation are eliminated. However, the controls tying in the movement of the tube 216 from its lower full position to its upper dotted line position with that of the operation of the pneumatic means for the tube 216 and the braking of the supply roll is the same as in the preferred embodiment. When the tube 216 reaches the upper dotted line position, a micro-switch LS2', identical to previously described switch LS2, in the preferred embodiment is closed to control the pneumatic and braking functions in the same manner as switch LS2. Also eliminated from the control circuitry are the controls for cutting the film, ejecting the product from the wrapping station, and releasing the product from the second support means.

A wrapping sequence is begun by placing a product P to be wrapped on the drive rolls 192 and 194 within the nip 200. The machine operator presses a start button similar to 120 in the preferred embodiment to begin a wrapping cycle. At the beginning of the cycle the wrapping film WF extends over the drive rolls 192 and 194 and beneath the product P and extends over the guide plate 202 to the cut-off line 204. The operator lifts lever 244 from the full line position to the dotted line position, as shown in FIG. 9, causing tube 216 to swing from the lower full line position through opening 226 in the guide plate 202 to the upper dotted line position. As in the preferred embodiment, sub-atmospheric pressure is created in tube 216, thereby drawing the wrapping film to the tube. Lifting the tube from the lower to the upper position, transfers the film from the guide plate to a position above the product to be wrapped. As in the preferred embodiment, air pressure within the tube 216 is changed from subatmospheric pressure to super-atmospheric pressure, thereby blowing the film away from the tube toward the product. The drive rolls are rotated in a clockwise direction, as viewed in FIG. 9, to rotate the product in a counter-clockwise direction and thereby cause the film transferred from the tube 216 to the product to be wrapped around the product. After a predetermined number of wraps of film have been taken on the product, drive rolls 192 and 194 are stopped in the same manner as in the preferred embodiment. However, since there is no automatic ejecting mechanism in this embodiment, the operator removes the wrapped product from the nip 200 after the drive rolls 192 and 194 have stopped and rolls the product along the guide plate 202 toward the second support means 206 where it comes to rest within the nip 212 between drive rolls 208, 210. As the product P rolls along guide plate 233, it is caused to rotate in a clockwise direction, thereby unwrapping a portion of the wrapping film which extends along the guide plate across slot 235. The operator then manually cuts the film along slot 235 creating two free ends at the cut-off line 204. After the film has been severed, the operator then actuates the drive mechanism for rolls 208, 210 for rotating the product P in a counter-clockwise direction, thereby rewrapping the portion of the film which extends from the product to the cut-off line 204 around the product. After this portion of the film has been wound on the product, the operator stops the drive for the rolls 208 and 210 and removes the wrapped product from the rolls. The portion of the film which extends from the first support means to the cut-off line 204 is now in position for a subsequent wrapping operation.

SECOND MODIFICATION

Figure 10:
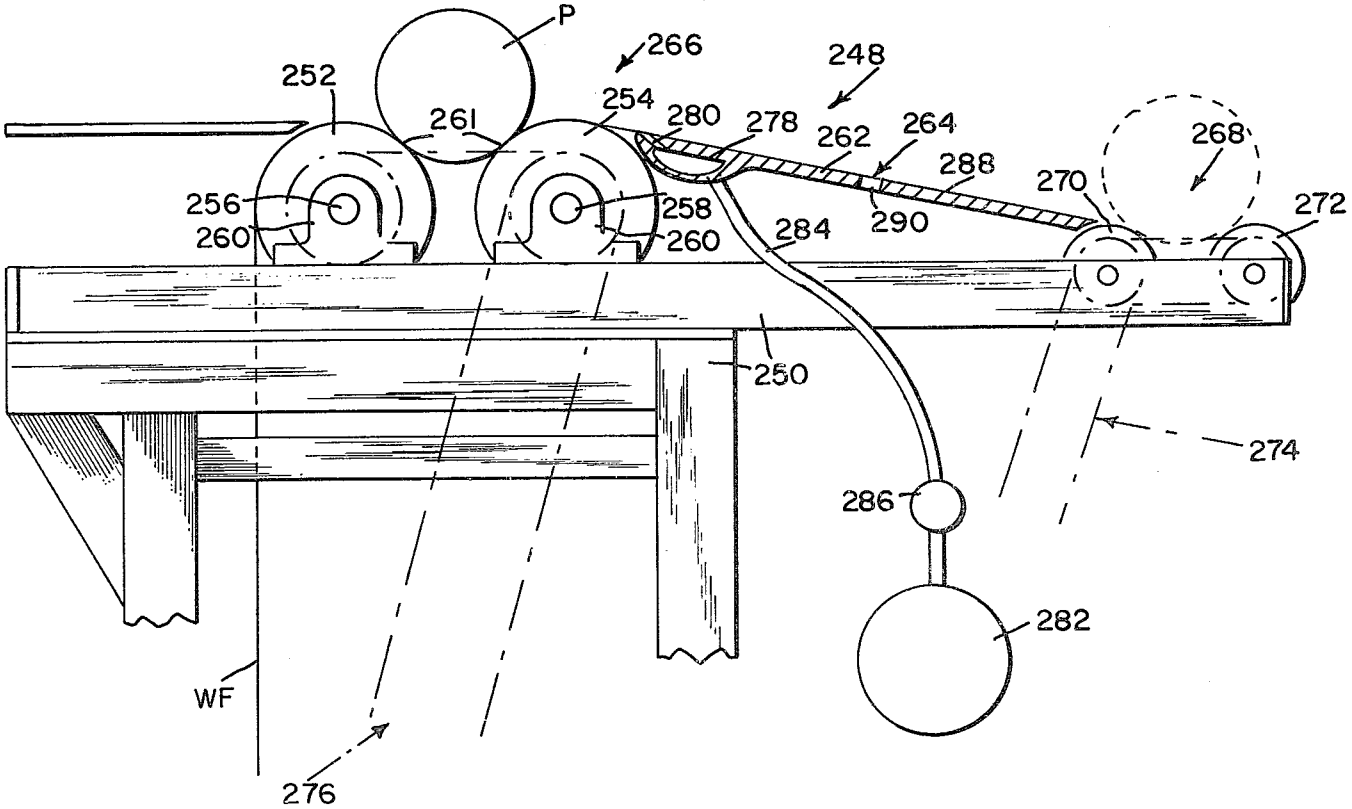
FIG. 10 is a second modification of the apparatus for carrying out the method of the present invention.

Referring to FIG. 10, there is shown a second modification indicated generally by the reference numeral 248 which comprises a framework 250 and a pair of spaced drive rolls 252 and 254 mounted on shafts 256 and 258, respectively, journaled in brackets 260 which are supported on the framework 250. As in the first modification, the wrapping film WF extends from a supply roll, not shown, over the drive rolls 252 and 254, over the guide plate 262 to a cut-off line 264. The product P to be wrapped is supported within the nip 261 between the drive rolls 252 and 254 which comprise a first supporting means, indicated generally by the reference numeral 266. A second supporting means indicated generally by the reference numeral 268 is located at the opposite end of guide plate 262 and comprises a pair of drive rolls 270 and 272 rotatably mounted within the framework 250. Drive means indicated generally by the number 274 are effective to drive rolls 270 and 272 in a clockwise direction, as viewed in FIG. 10. Drive means 274 may be any conventional type of drive, including chain and sprocket means driven from a separate motor, not shown, which may be manually controlled by the operator. The drive means for drive rolls 252 and 254, indicated generally by the reference numeral 276, also includes chain and sprocket elements driven from a separate motor, not shown, in the same manner as in the first modification and in the preferred embodiment.

In the embodiment shown in FIG. 10, the means for transferring the film to the product to be wrapped comprises a stationary tube 278 at the end of the guide plate 262 adjacent drive roll 254. Tube 278 has a plurality of apertures 280 extending along the length of the tube across the width of the machine. Tube 278 is connected to a source of super-atmospheric pressure 282 by means of a flexible tube 284. A valve 286 controlled by the operator enables the tube 278 to be selectively connected to the source of super-atmospheric pressure 282. The apertures 280 are located so as to direct streams of air above a product P supported on the drive rolls 252 and 254 when the tube 278 is pressurized.

The operation of the second modification, shown in FIG. 10, is primarily manual. The operator places a product to be wrapped within the supporting nip 261 and actuates valve 286 to connect tube 278 to the source of super-atmospheric pressure 282. This causes air flowing out through apertures 280 to transfer the portion of the film extending on top of guide plate 262 from drive roll 254 to the cut-off line 264 to be blown toward the product P so that it adheres to the product. Since there is no swinging transfer arm to actuate a limit switch, as in the preferred embodiment and the first modification, the operator disconnects tube 278 from the source of super-atmospheric pressure 282 by means of valve 286 and manually closes a switch similar to switch LS2 in the preferred embodiment to rotate the drive rolls 252 and 254 in a clockwise direction, as viewed in FIG. 10, causing the product P to rotate in the counter-clockwise direction, thereby wrapping the film WF about the product. The control circuitry for the second modification 248 is simplified to include only those portions of the circuitry shown in FIG. 12 for controlling the rotation of the drive rolls and the braking means for the supply roll of wrapping film in the same manner as in the preferred embodiment. As in the preferred embodiment, the drive rolls will automatically stop after a predermined number of rotations. The operator then removes the wrapped product P from the nip 261 and places it on the guide plate 262 which declines toward the second supporting means 268 and allows it to roll toward the second supporting means. As the product rolls along the upper surface 288 of the support plate 262 it rotates in a clockwise direction thereby unwrapping a portion of the wrapping film WF so that when the product arrives at the second supporting means 268, a section of wrapping film extends from drive roll 254 across the top surface 288 of the guide plate 262 to the product P on the second supporting means. The operator then cuts the film along cut-off line 264 utilizing a slot 290 in the guide plate 262 as a guide. After cutting the film, the operator then starts the drive means 274 for rotating the drive rolls 270 and 272 in the clockwise direction, as viewed in FIG. 10 to rotate the product P in the counter-clockwise direction and thereby wrap portions of film which extends from the product to the cut-off line 264 to complete the wrapping cycle. The operator then disconnects the drive to the rolls 270 and 272 and removes the wrapped product P from the second supporting means 268.

THIRD MODIFICATION

Figure 11:
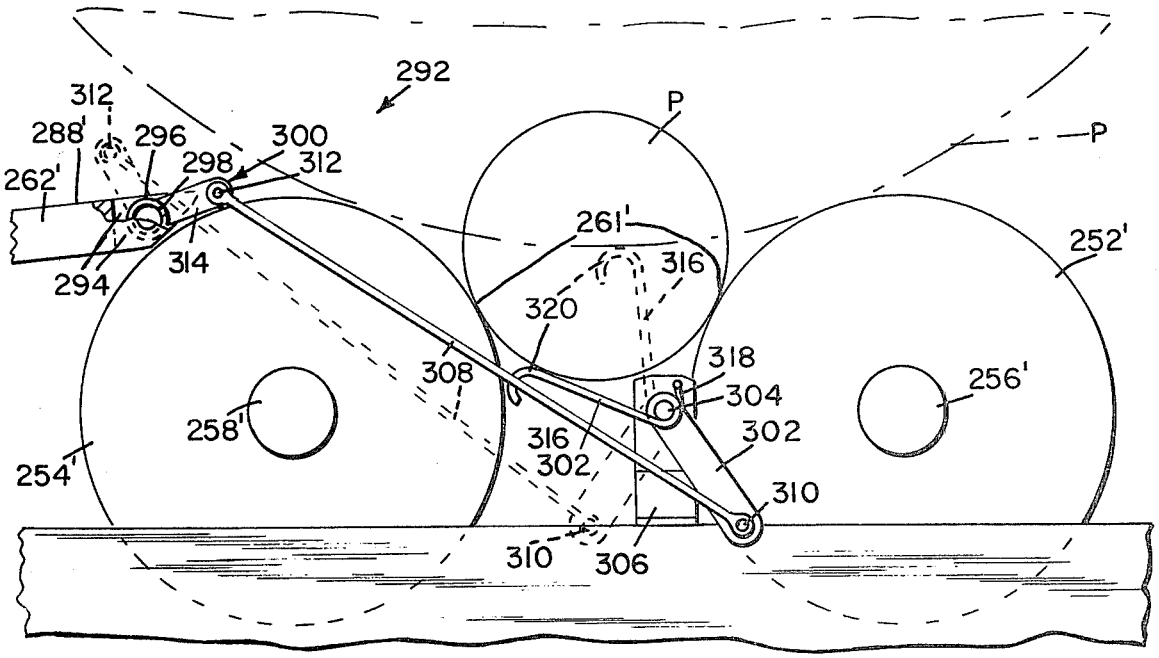
FIG. 11 is a rear elevational view of a third modification of the apparatus for carrying out the method of the present invention.

Referring to FIG. 11, where is shown a third modification generally indicated by the reference numeral 292 and is identical to the second modification 248, shown in FIG. 10, in both structure and operation, except for the construction of the tube at the end of the guide plate. Only those portions which differentiate the third modification from the second modification are shown in FIG. 11. Modification 292 includes a guide plate 262' similar to plate 262 and includes an upper guiding surface 288'. Guide plate 262' differs from guide plate 262 of the second modification in that the end of the guide plate adjacent drive roll 254' is bifurcated at 294 for pivotally supporting a tube 296 having a plurality of apertures 298. Tube 296 is rotatably mounted so that it can be moved to position its apertures 298 in different angular positions to accommodate products having a wide range of diameters. Tube 296 is automatically positioned in accordance with the diameter of the product by tube positioning means generally indicated by the reference numeral 300. The positioning means 300 comprises a lever 302 pivotally attached at 304 to a fixed bracket 306. One end of a connecting rod 308 is pivotally attached to the end of lever 302 and the opposite end of rod 308 is pivotally connected at 312 to the end of a lever 314 fixed to tube 296. A sensing finger 316 is fixed to lever 302 and extends from the lever toward the nip 261' between drive rolls 252' and 254'. Sensing finger 316 is biased toward the dotted line position, as shown in FIG. 11, by a coil spring 318 anchored to the bracket 306. When a product P is placed within the nip 261', it engages a curved end portion 320 of the sensing finger 316 and forces it toward the full line position to a sensing position which will depend on the diameter of the product P to be wrapped. The finger 316 will be depressed to the full line position by the smallest diameter package P, shown in full lines and will remain in the upper dotted line position when a product P having the largest diameter is placed within the nip 261'. As the finger 316 is moved from its dotted line position toward the full line position, it will cause the lever 302 to pivot from the dotted line position to the full line position by means of the connecting rod 308. Tube 296 will, accordingly, be positioned so that its apertures 298 will be directed towards a point just above the upper surface of a product P, shown in full line, having the smallest diameter which can be accommodated by the third modification 292. As products of increasing diameter are placed within the nip 261', sensing finger 316 will move closer to its dotted line position and thereby cause apertures 298 to be directed at a higher angle, so that they are always directed toward a point just above the upper surface of the product.

In all of the modifications, only the wrapping film is depicted, it being understood that a leader film may also be used when conditions warrant its use in which case the leader film and the wrapper film will extend about the drive rolls in the same manner as shown in the preferred embodiment.

It can be seen that the invention encompasses simplified hand-operated machines, which are relatively inexpensive, to sophisticated automatic machinery for high production and savings in labor. The type of machinery employed depends upon the particular needs of the customer. The degree of versatility afforded by the embodiment, shown in FIG. 11, will, of course, depend on whether the products to be wrapped have the same or different diameters. The use of a leader film enables certain products to be wrapped which might not be wrapped by the use of a wrapper film alone, thereby giving added versatility to the machines made in accordance with the present invention. The present method enables a product to be wrapped with a single sheet of wrapping film under sufficient tension, so that after the product has been wrapped it is ready for storage or shipment without the need of a shrink tunnel or the like.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. Packaging apparatus for wrapping a generally cylindrical product with plastic film having sufficient softness and frictional characteristics for enabling the film to adhere to the surface of the product upon contact therewith, the apparatus comprising:

(a) first support means for supporting the product so that its central longitudinal axis is generally horizontal and for rotating the product about said axis in a first direction, (b) second support means spaced from the first support means for supporting the product so that its central longitudinal axis is generally horizontal, (c) a supply roll of product adhering plastic film having a free end which extends from the supply roll between the first support means and the product supported thereon to a cut-off line between the first and second support means, (d) means for transferring the end of the film from the cut-off line to the product to enable the film to adhere to the surface of the product and cause the film to be wrapped around the product as it is rotated by the first support means, (e) means for guiding the wrapped product from the first support means to the second support means so that the product rotates in the direction opposite to said first direction, thereby partially unwrapping the film from the product to allow the film to be severed along said cut-off line, and (f) means for rotating the product in said first direction after the film has been severed to wrap the portion of film extending from the product to the cut end to be wrapped onto the product.

2. Packaging apparatus as set forth in claim 1, wherein the means for transferring the free end of the film to the product comprises means for blowing air against the underside of the film between the first support means and cut-off line toward the product with sufficient force to direct the free end of the film against the product.

3. Packaging apparatus as set forth in claim 2, wherein the means for blowing air comprises:

(a) an elongated tube located between the first and second support means and below the portion of the film extending from the first support means to the cut-off line, the tube having a plurality of apertures facing the product on the first support means, and (b) means for creating super-atmospheric pressure in the tube for creating air streams through the apertures in the tube toward the product.

4. Packaging apparatus as set forth in claim 3, wherein the tube is generally cylindrical, the central longitudinal axis of which is parallel to the central longitudinal axis of the product on the first support means.

5. Packaging apparatus as set forth in claim 4, wherein the tube is adjustably mounted for partial rotation about its central longitudinal axis for varying the angle of the air streams toward the product on the first support means to enable products of different diameters to be wrapped.

6. Packaging apparatus as set forth in claim 5, comprising tube actuating means responsive to the diameter of the product for automatically adjusting the position of the tube so that air streams will always be directed toward the product, whereby products having diameters within a specified range will be automatically wrapped.

7. Packaging apparatus as set forth in claim 6, wherein the tube actuating means comprises:

(a) a follower pivotally mounted for movement along an arc and having a surface for engaging the peripheral surface of the product on the first support means at a point which causes the follower to vary its position along said arc in accordance with the diameter of the product, and (b) lever means operatively connecting the follower to the tube for rotating the tube in accordance with the diameter of the product so that the vertical angle of the air streams will be greater for products having a large diameter and smaller for products having a small diameter.

8. Packaging apparatus as set forth in claim 5, wherein the guide means is a flat plate extending between the first and second support means and above the tube and comprising an opening extending along the length of the tube and a slot extending along the cut-off line to enable the film to be severed along said line.

9. Packaging apparatus as set forth in claim 2, wherein the guide means is a flat plate extending between the first and second support means and comprising a slot extending along the cut-off line to enable the film to be severed along said line.

10. Packaging apparatus as set forth in claim 9, wherein the means for blowing air comprises:

(a) an elongated tube integrally formed with the portion of the plate which is adjacent the first support means, the tube having a plurality of apertures facing the product on the first support means, and (b) means for creating super-atmospheric pressure in the tube for creating air streams through the apertures in the tube toward the product.

11. Packaging apparatus as set forth in claim 1, wherein the first support means comprises a pair of parallel rolls, at least one of which is rotatably driven, the rolls being spaced to allow the film to extend upwardly between the rolls and over the roll which acts as a the guide means.

12. Packaging apparatus as set forth in claim 1, wherein the second support means comprises a pair of spaced parallel rolls, at least one of which is rotatably driven to function as the means for rotating the product after the film has been severed.

13. Packaging apparatus as set forth in claim 1, wherein the means for transferring the free end of the film to the product comprises:

(a) a tubular member, the central longitudinal axis of which extends parallel to the central longitudinal axis of the product to be wrapped, the tubular member having apertures along its length and is pivotally mounted about an axis below the portion of the film which extends from the first support means to the cut-off line to a top position above the product to be wrapped, (b) means for creating super-atmospheric pressure in the tubular member after it has reached the top position, thereby blowing air out of the apertures for releasing the film to be wrapped on the product as the product is rotated by the first support means.

14. Packaging apparatus as set forth in claim 13, comprising means for creating sub-atmospheric pressure in the tubular member as it travels from the bottom position to the top position to draw the film against the tubular member to assist the tubular member to transfer the free end of the film to the product.

15. Packaging apparatus as set forth in claim 14, wherein the means for creating sub-atmospheric and super-atmospheric pressure in the tubular member comprises:

(a) an air pump having a suction port and a blower port, (b) a flexible tube, one end of which is connected to the tubular member and the other end of which has an air inlet, and (c) means for selectively connecting the air inlet of the flexible tube to either the suction port or the blower port of the air pump.

16. Packaging apparatus as set forth in claim 13, wherein the pivotal mounting for the tubular member is adjustable for changing the pivoting axis of the tubular member so that the tubular member will occupy different top and bottom positions to accomodate products of different sizes.

17. Packaging apparatus as set forth in claim 13, wherein the guide means comprises a flat plate extending from the first support means to the second support means, the flat plate comprising:

(a) a first elongated opening adjacent the first support means, (b) a second elongated opening spaced from the first opening and adjacent the second support means, (c) a first elongated slot between the first and second opening, and (d) a second elongated slot between the second opening and the second support means, the pivotal mounting for the tubular member being adjustable for occupying a first position and a second position, wherein in the first position, the tubular member moves along a first arc between the top and bottom positions through the first opening for wrapping products of relatively small diameters and in the second position the tubular member moves along a second arc between the top and bottom positions through the second opening for wrapping products of relatively large diameter, the cut-off line being located along the first slot when the tubular member is in said first position and along the second slot when the tubular member is in said second position.

18. Packaging apparatus as set forth in claim 1, wherein the second support means comprises a product supporting element movable between a product supporting position and a product releasing position and the means for rotating the product in said first direction after the film has been severed comprises a sloped surface positioned below the product supporting element which is engaged by the product after it is released by the product supporting element and which causes the product to rotate in said first direction as it rolls along the sloped surface.

19. Packaging apparatus as set forth in claim 1 wherein the supply roll of film is a rotatably mounted and said apparatus comprises:

(a) a variable electromagnetic brake operatively connected to the film roll for applying a braking force on the film roll and thereby creating a tension in the film as it is drawn from the film roll by the product as it is rotated by the first support means, (b) means for adjusting the braking force of the brake to vary the tension in the film drawn from the film roll.

20. Packaging apparatus as set forth in claim 19, comprising control means for the electromagnetic brake, the control means being operative to maintain the brake normally deactivated and to activate the brake during wrapping of film onto the product.

21. Packaging apparatus as set forth in claim 1, wherein the first support means includes at least one drive roll for rotating the object, the apparatus comprising:

(a) electrical drive means for the drive roll, (b) electrical circuitry including a start button for energizing the drive means, and (c) means for counting the revolutions of the drive roll and de-energizing the electrical drive means after a predetermined number of revolutions of the drive roll.

22. Packaging apparatus as set forth in claim 21, wherein the counting means comprises:

(a) an electric timer forming part of the electric circuitry so as to be activated by closing of the start button, the timer being effective to de-energize the electrical drive means upon receiving a predetermined number of electrical pulses, and (b) means for providing electrical pulses to the electric timer in accordance with the revolutions of the drive roll.

23. Packaging apparatus as set forth in claim 22, wherein the electrical timer is adjustable so that it can be set to de-energize the electrical drive means for different numbers of electrical pulses and is automatically reset after each counting sequence.

24. Packaging apparatus as set forth in claim 22, wherein the means for providing electrical pulses to the electric timer comprises:

(a) a normally open switch forming part of the electrical circuitry, the switch being effective when closed to supply the electric timer with an electric pulse, and (b) a protuberance on the drive roll for momentarily closing the switch for each revolution of the drive roll.

25. Packaging apparatus as set forth in claim 18, wherein the supply roll of wrapping film is rotatably mounted and said apparatus comprises:

(a) a variable brake for applying a braking force on the film roll, the brake being connected to the electrical circuitry so that it is activated and deactivated simultaneously with the respective activation and deactivation of the electrical drive means for the drive roll.

26. Packaging apparatus as set forth in claim 1, wherein the first support means comprises a pair of spaced parallel horizontal rolls forming a supporting nip therebetween for supporting the product, one of said rolls acting as said guide means at least one of the rolls being rotatably driven for rotating the product about its central longitudinal axis and wherein the free end of the wrapping film extends upwardly between the pair of rolls, over one of the pair of rolls which is nearest the cut-off line and terminates at the cut-off line, the apparatus comprising a supply roll of starter film which is substantially narrow with respect to the wrapping film and having a free end which extends from its supply roll over the pair of rolls and terminates at the cut-off line, whereby the ends of each film will be transferred to the product supported in the supporting nip by the transferring means and both films will be wrapped around the product as it is rotated.

27. Packaging apparatus as set forth in claim 1, comprising means for severing the film along the cut-off line after the wrapped product has reached the second support means.

28. Packaging apparatus as set forth in claim 1, comprising means for removing the wrapped product from the first support means.

29. Packaging apparatus as set forth in claim 28, wherein the first support means comprises a pair of spaced rolls forming a product supporting nip therebetween, at least one of which is rotatably driven and the means for removing the wrapped product from the support means comprises:

(a) a pivoted lever, (b) a product engaging member fixed to the lever and extending between the pair of rolls, (c) means for actuating the lever so that the product engaging member moves from a normally inactive position beneath the product in the supporting nip to an active position, wherein the product is engaged by the product engaging member and pushed out of the supporting nip.

30. Method of wrapping a generally cylindrical product with plastic film having sufficient softness and frictional characteristics for enabling the film to adhere to the surface of the product upon contact therewith, comprising the following steps:

(a) extending a free end of the film from a supply of film over a supporting means to a cut-off line spaced from the supporting means, (b) placing the cylindrical product against the film on the supporting means, (c) transferring the free end of the film against the product so that it adheres to the product, (d) rotating the product on the supporting means about its central longitudinal axis in one direction to wrap the wrapping film around the product, (e) rolling the product toward said cut-off line to a point beyond the cut-off line so that the product rotates about its central longitudinal axis in the direction opposite from said one direction, thereby partially unwrapping the film from the product so that it extends across the cut-off line, (f) cutting the film along the cut-off line, and (g) rotating the product in said one direction to wrap the portion of the film which extends from the product to the cut-off line onto the product.

31. Method of wrapping a generally cylindrical product as set forth in claim 30, wherein the step of transferring the free end of the film against the product comprises directing an air stream against the underside of the film between the support means and cut-off line toward the product.

32. Method of wrapping a generally cylindrical product as set forth in claim 30 comprising the step of applying tension to the wrapping film during rotation of the product on the supporting means to produce a tight film on the product.

* * * * *